United States Patent [19]

Davis et al.

[11] Patent Number: 4,733,906

[45] Date of Patent: Mar. 29, 1988

[54] SUNSHADE FOR INFANTS FOR ATTACHMENT TO A CAR SEAT

[76] Inventors: Carol S. Davis, 539 Mt. Crest, Duarte, Calif. 91010; Nancy R. Impastato, 1164 Glentana St., Covina, Calif. 91722

[21] Appl. No.: 872,847

[22] Filed: Jun. 11, 1986

[51] Int. Cl.[4] ..... A47C 7/10

[52] U.S. Cl. ..... 297/184; 297/224

[58] Field of Search ..... 297/184, 218, 219, 224, 297/226; 296/102; 135/16

[56] References Cited

U.S. PATENT DOCUMENTS

| | | | |
|---|---|---|---|
| 1,897,525 | 2/1933 | McGill | 297/184 X |
| 2,744,567 | 5/1956 | Larkin | 297/219 |
| 2,982,562 | 5/1961 | Gladstein | 297/184 X |
| 3,003,816 | 10/1961 | Wilson | 297/219 |
| 3,738,703 | 6/1973 | Kunimatu | 297/184 |
| 3,840,161 | 10/1974 | Boggs et al. | 297/184 X |
| 3,873,117 | 3/1975 | Perego | 297/184 X |
| 4,293,162 | 10/1981 | Pap et al. | 297/184 |
| 4,378,946 | 4/1983 | Voytko et al. | 247/184 X |
| 4,478,453 | 10/1984 | Schutz | 297/219 |
| 4,536,028 | 8/1985 | Jones et al. | 297/224 |
| 4,579,385 | 4/1986 | Koenig | 297/184 |

FOREIGN PATENT DOCUMENTS

| | | | |
|---|---|---|---|
| 1076985 | 11/1954 | France | 297/184 |

*Primary Examiner*—Kenneth J. Dorner
*Assistant Examiner*—José V. Chen
*Attorney, Agent, or Firm*—Edgar W. Averill, Jr.

[57] ABSTRACT

A sunshade for infants affixable to essentially all styles of car seats. The sunshade has a generally rectangular fabric shade which is supported by a generally U-shaped support bar made from a stiff, but bendable material. An elastic cord is affixed to the back and to a portion of each of the side edges and the shade is held in a generally horizontal position by the action of the support bar, the elastic cord and the fabric shade, itself.

7 Claims, 6 Drawing Figures

SUNSHADE FOR INFANTS FOR ATTACHMENT TO A CAR SEAT

BACKGROUND OF THE INVENTION

The field of the invention is car seats for infants and the invention relates more particularly to sunshades attachable to such car seats.

Although baby carriages inevitably have sunshades attached thereto, they are invariably affixed by a wire frame through several holes in the frame of the carriage. One such approach is shown in U.S. Pat. No. 3,873,117 where a rigid frame 66 is sewn into a fabric cover and the frame is inserted into a hole in a pair of vertical rods 3 of the carriage. A similar approach is shown in U.S. Pat. No. 4,378,946 where a bail 26 is held by a hole in arms 16*a* and 16*b*. Another approach has been to provide a car seat, carriage, or the like to which a metal support rod is affixable which, in turn, can hold a sunshade. Such approach is shown in U.S. Pat. Nos. 4,293,162 and 3,258,291. Of course, such approaches can only be used with seats which are specifically designed for their use.

SUMMARY OF THE INVENTION

It is an object of the present invention to provide a sunshade for infants affixable to essentially all styles of car seats.

The present invention is for such sunshade comprising a generally rectangular fabric shade having a front which extends over the car seat, two sides, and a back, which back extends around the back of such car seat. A generally U-shaped support bar is held at its front to said shade near the front thereof. Both arms of the support bar are held near the sides of the fabric shade, and the ends of the bar extend only slightly past the sides of the shade along the back. The bar is made from a stiff, but bendable material and the bar is shaped to require that its arms be flexed outwardly to be placed over the car seat to which it is to be applied. An elastic cord is affixed to said shade along the back thereof at the back edge and extending from the back edge along each of the sides and terminating at a mid-point of each side. The U-shaped support bar is positioned inwardly with respect to the elastic cord whereby when the sunshade is placed over the top of a car seat, the support bar is urged inwardly to provide a pivot point with the edge of the car seat at each edge thereof at a point downward from the top of the car seat, and the elastic cord pulls the back edge inwardly against the back of the car seat, and the front edge of the support bar is held up by tension in the fabric between the top of the car seat and the front of the support bar. Preferably, the bar has a side silhouette in the shape of a shallow arc and is positioned about three and one-half inches inboard with respect to the elastic cord where both elements co-exist. The elastic cord, preferably, extends about one-half of the distance along each side toward the front edge of the shade.

DESCRIPTION OF THE PREFERRED EMBODIMENTS

Figures 1, 2, 3, 4, 5, 6:
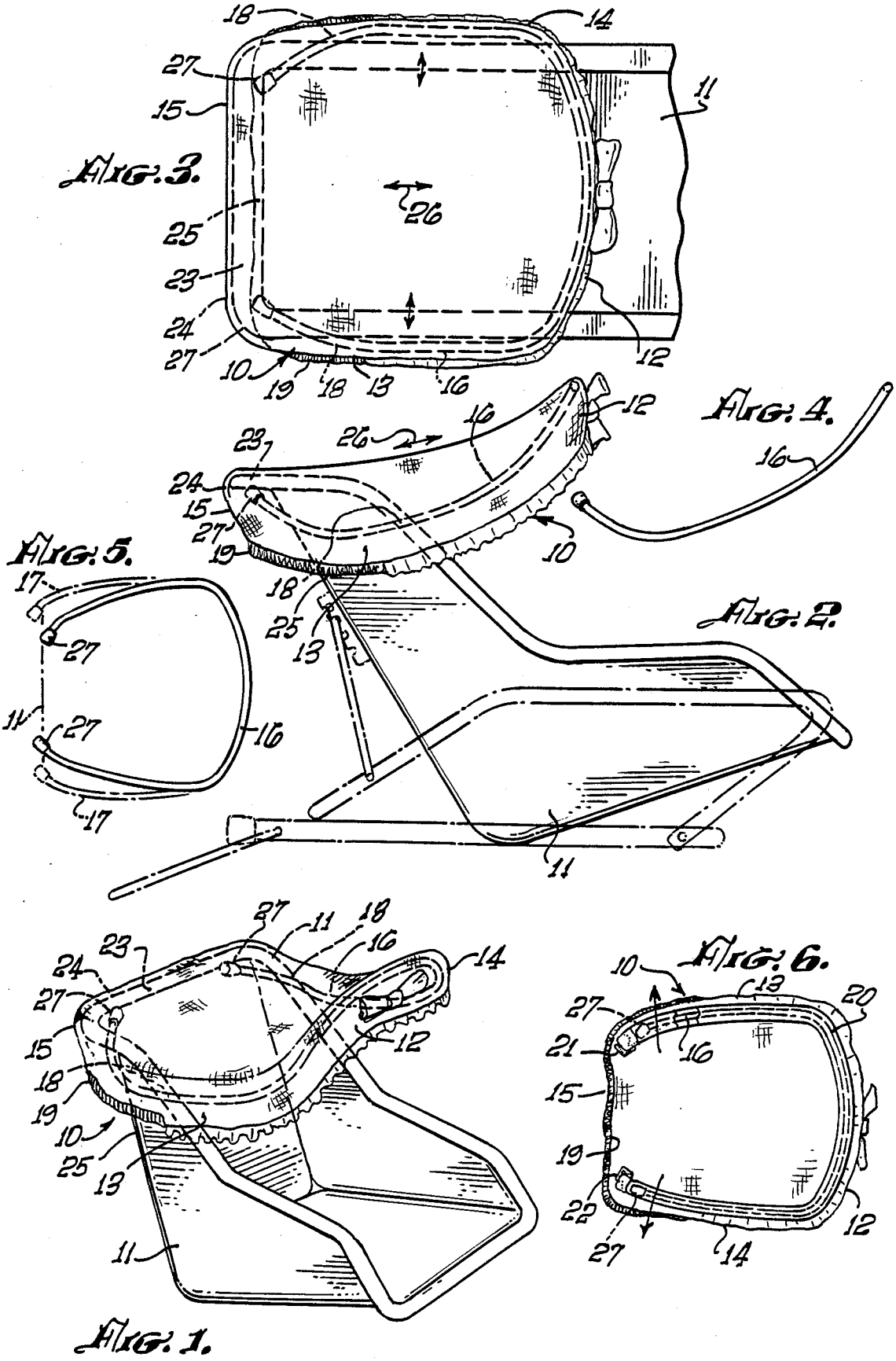
FIG. 1 is a perspective view of a car seat with the sunshade of the present invention affixed thereto.
FIG. 2 is a side view of the car seat and the sunshade of FIG. 1.
FIG. 3 is a top view thereof.
FIG. 4 is a side view of the U-shaped support bar of the sunshade of FIG. 1.
FIG. 5 is a top view of the generally U-shaped bar of FIG. 4 in its relaxed configuration, showing its in-use configuration in phantom line.
FIG. 6 is a bottom plan view of the sunshade of FIG. 1.

The sunshade of the present invention is shown in perspective view in FIG. 1 and indicated generally by reference character 10. Sunshade 10 is applied over the top of a car seat 11, car seat 11 being of the commonly used type molded from a single sheet of plastic. Such car seats typically include support bars for affixing the same to a car seat but such support bars, not forming a part of the present invention, are only indicated generally in the drawings in phantom lines in FIG. 2.

Sunshade 10 has a front 12, a right side 13, a left side 14 and a back 15 shown best in FIG. 3. Sunshade 10 is preferably fabricated from a soft fabric which is sufficiently opaque to shade the sun from the infant in the car seat.

A generally U-shaped bar is fabricated from a stiff, but bendable material such as poly vinyl chloride rigid plastic pipe which may be formed into a generally U-shaped shape by heating. Alternatively, bendable metal wire covered with non-toxic plastic may be used. As shown in FIG. 4, the bar forms a gentle arc when viewed from its side. In its relaxed configuration as viewed from the top, it can be seen in FIG. 5 that support bar 16 must be flexed outwardly to the position shown in phantom lines and indicated by reference character 17 to fit over the top and back of car seat 11. Because bar 16 is fabricated from a stiff material, it thus causes an inward pivot point along both edges of the car seat as indicated by reference character 18 in FIGS. 1, 2 and 3. This functions together with the elastic cord to provide support for the front 12 of the sunshade as discussed below.

An elastic cord 19 is sewn along the back edge 15 and about half way along sides 13 and 14 as shown from a bottom view in FIG. 6. FIG. 6 is depicted with the elastic in a stretched configuration since it is sewn into sunshade 10 in a manner so that it tends to gather up the back and the back half of sides 13 and 14 as shown in FIGS. 1 and 2 of the drawings. For instance, in a typical unit, the elastic has a relaxed length of about ten inches and yet is sewn along the back edge which has an original width of about twenty-one inches and along about one-half of each of the sides which are about eighteen inches in length in the ascut size.

The support bar is sewn into a pocket 20 which may be removably closed by straps 21 and 22 held by Velcro so that the bar may be removed for washing the sunshade. The support bar is positioned about three and one-half inches inwardly from the edge of the fabric, whereas the elastic is held at the edge, thus causing the elastic to pull the fabric inwardly with respect to the support bar.

The manner in which the support bar and elastic holds the top in a generally horizontal position is shown best in FIG. 2. Car seat 11 has a top 23 which curves to a back edge 24. When the sunshade 10 is installed on car seat 11, the support bar 16 is bent, or flexed, outwardly and bar 16 is moved downwardly as far as the fabric of the sunshade permits. This brings it to rest at a point where the support bar 16 contacts the edge of the car seat at the pivot point indicated by reference character 18. The elastic cord 19, of course, pulls the back and sides of the fabric inwardly against the back 25 and the result is that the fabric of sunshade 10 can only be pulled towards the front 12 of the car seat a limited amount. Since the support bar 16 is held at pivot point 18, and since the amount of fabric which can be pulled forward is limited, a slight amount of tension results in the direction indicated by arrow 26. This holds the front edge 12 of the sunshade upwardly as shown in FIG. 2 and in a generally horizontal position. The relative position of the sunshade, support bar and car seat is shown from a top view of FIG. 3 where it can also be seen that the support bar 16 contacts the edges of the car seat at the pivot point indicated by reference character 18.

Support bar 16 should be fabricated from a stiff, and preferably, a light material and protective caps 27 are preferably placed over the ends thereof. Of course, a fringe is, preferably, provided to increase the ability of the sunshade to provide shade in occasions where the sun is relatively low in the horizon. Another advantage of the sunshade of the present invention is the ability to adjust the shade by flexing the support bar outwardly and moving it up or down along the back of the car seat. The further up the bar is moved, the lower the top of the sunshade will rest. The result is a device which may be readily applied to essentially any design of car seat, is light in weight and safe to use.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An infant seat and sunshade comprising:

an infant seat having right and left sides and an upper edge, said infant seat including a back formed with an outwardly directed flange at the upper edge thereof;

a generally rectangular fabric shade having a front which is cantilevered over the infant seat, two sides, a back, and a back edge which extend around the outwardly directed flange of the back of said infant seat;

a generally U-shaped support bar having two arms extending from a base, said support bar being held at its base to said fabric shade near the front thereof, both arms of said bar being held near the sides of the fabric shade and the ends of the support bar extending only slightly past the sides of the shade along the back, said support bar being made from a stiff but bendable material, said bar being shaped to require that its arms be moved outwardly to be placed over the infant seat to which it is applied so that said bar frictionally engages the right and left sides of the infant seat;

an elastic cord affixed to said fabric shade along the back thereof, at the back edge and extending from the back along each of the sides and terminating at a midpoint of each side of said fabric shade, said U-shaped support bar being inward with respect to said elastic cord whereby the support bar is urged inwardly to provide pivot points with the right and left sides of the infant seats at each edge thereof at a point downward from the upper edge of the infant seat, and the elastic cord pulls the back edge inwardly over the outwardly directed flange and against the back of the infant seat, and the front edge of the support bar is held up by tension in the fabric between the top of the infant seat and the front of the support bar and by the frictional engagement of the U-shaped support bar at the pivot points.

2. The sunshade for infants of claim 1 wherein the silhouette of said support bar when viewed from the side thereof is a shallow arc.

3. The sunshade for infants of claim 2 wherein said support bar is about three and one-half inches inboard with respect to said elastic cord where both elements co-exist.

4. The sunshade for infants of claim 1 wherein the elastic cord extends about one-half of the distance along each side toward the front edge of the shade.

5. The sunshade for infants of claim 4 wherein the elastic cord is affixed at the back and side edges of the shade.

6. The sunshade for infants of claim 1 wherein said support bar is fabricated from rigid plastic tubing.

7. The sunshade for infants of claim 1 wherein said infant seat has a seat and back portion which is a one-piece plastic member.

* * * * *